United States Patent [19]

Schleimann-Jensen

[11] 4,424,026

[45] Jan. 3, 1984

[54] EQUIPMENT FOR MANUFACTURING GAS-FILLED DISCHARGE TUBES FOR USE AS TRANSIENT PROTECTION

[75] Inventor: C. Arne Schleimann-Jensen, Stockholm, Sweden

[73] Assignee: TII Industries, Inc., Copiague, N.Y.

[21] Appl. No.: 322,237

[22] Filed: Nov. 17, 1981

[51] Int. Cl.[3] ..... F27D 3/04; F27D 1/18; F27B 5/04

[52] U.S. Cl. ..... 432/125; 432/198; 432/204; 432/242

[58] Field of Search ..... 432/125, 198, 200, 203, 432/204, 205, 253, 242; 316/12; 228/219, 220; 445/37, 17

[56] References Cited

U.S. PATENT DOCUMENTS

| | | | |
|---|---|---|---|
| 218,529 | 8/1879 | Hawkins | 432/125 |
| 1,659,550 | 2/1928 | Steenstrup | 228/219 |
| 1,723,538 | 8/1929 | Batie | 432/125 |
| 1,852,800 | 4/1932 | Childs et al. | 432/125 |
| 2,124,162 | 7/1938 | Eddison et al. | 445/57 |
| 2,315,294 | 3/1943 | Stewart et al. | 228/219 |

*Primary Examiner*—John J. Camby
*Attorney, Agent, or Firm*—Leonard W. Suroff

[57] ABSTRACT

A furnace system adapted to perform various manufacturing phases in the production of gas-filled discharge tubes designed as transient protectors includes at least two vertically spaced treatment tube sections separated from each other by a sealing tube. Treatment trays pass through the sealing tube in a vertical direction; the inside of the sealing tube and the outside of the treatment trays are adjusted to each other in terms of dimensions and materials so that there is obtained adequate sealing between the treatment sections while maintaining a sufficiently low coefficient of friction to permit the treatment trays to readily pass therethrough.

17 Claims, 8 Drawing Figures

EQUIPMENT FOR MANUFACTURING GAS-FILLED DISCHARGE TUBES FOR USE AS TRANSIENT PROTECTION

BACKGROUND OF THE INVENTION

Gas-filled discharge tubes for use as transient protectors are most frequently manufactured in the form of two-electrode tubes. Three-electrode tubes with a central electrode placed between two end electrodes are also frequently fabricated. As a whole, the manufacturing is done in the same manner with both categories.

A frequently occurring embodiment of two-electrode tubes has two electrodes, consisting of e.g. "Kovar" or nickel-iron, which are pressed onto either end of a ceramic tube which has metalized outer cylinder surfaces near its ends. The metallization usually consists of molybdenum-manganese which is coated with a surface layer of nickel. In a hole in one electrode there is introduced an exhaust tube. The exhaust tube is often of copper. Adjoining the electrodes and around the exhaust tube at the hole in the electrode are placed rings of soldering material, often a silver-copper eutectic.

The assembled tube unit is placed in a reducing hydrogen atmosphere and gradually heated to the melting point of the soldering material, which for a copper-silver eutectic, is just under 800° C. The melted soldering material penetrates between the electrodes and the metalized end areas of the ceramic tube, thereby soldering them together. At the same time the soldering material melts and joins the exhaust tube to its electrode.

After soldering and subsequent cooling to room temperature, each tube, by means of the exhaust tube, is placed in a separate vacuum chuck, which in turn is connected to a vacuum installation. During simultaneous heating to about 400° C. the tubes are vacuum-pumped and, when the pressure has reached about 0.01 Pa, a suitable gas, often argon with a few percent of hydrogen, is fed into the tubes, so as to generate therein a gas pressure that is suited for their subsequent function. The copper exhaust tubes are thereafter pinched off with suitable pliers, which results in a cold diffusion weld that closes each tube vacuum-tight. Manufacturing is completed by an electric stabilization treatment before final testing.

In the last decade the above-described manufacturing method has to a large extent being replaced by batch manufacturing. This method involves the manufacturing of tubes without an exhaust tube. In a typical example of a two-electrode tube designed for this manufacturing method, the electrodes are often made of pure copper, but other materials such as "Kovar" (trademark for an iron-nickel-cobalt alloy) or nickel-iron can also be used. The ceramic tube has its plane end surfaces metalized. The components are stacked loosely upon each other. First an electrode, thereafter a solder ring, then the ceramic tube and finally a second solder ring and a second electrode. The simultaneous stacking of a few hundred tubes on a suitable treatment plate can be done semiautomatically. A number of such plates with stacked tubes are placed jointly in a furnace in which vacuum pumping to about 0.01 Pa occurs at a temperature slightly below the melting point of the soldering material. The loose stacking of the tube components brings about a vacuum that is originated also inside the tube units. At unchanged temperature refill gases, which, also in this case, are frequently argon with a few percent of hydrogen, are introduced into the furnace space and thereby also into the stacked tubes, so that the desired pressure is obtained. The temperature is increased and the tubes are soldered together in the gaseous atmosphere. Also in this case, after cooling there follows an electric stabilization treatment before final testing.

Neither of these manufacturing methods are suited for continuous automatic manufacturing, and both methods require complex manufacturing equipment.

In the U.S. patent application Ser. No. 213,909, filed Dec. 8, 1980, now U.S. Pat. No. 4,383,723 however, a manufacturing method is described that is based on simple manufacturing equipment and that offers good possibilities for continuous automatic manufacturing. The manufacturing can e.g. occur substantially at atmospheric pressure in a belt-furnace provided with three sections separated by walls, which allow the treatment plates with the stacked tubes to pass through, but which at the same time present a certain hindrance to the gas flow between the sections. Since it is mainly atmospheric pressure that prevails in all three sections, and since the gases used in the sections can be made to follow suitable flow paths between the sections, there are no severe sealing requirements with regard to the separation walls.

The manufacturing method is based on the fact that the heavy gases, such as the gases often used in this connection, argon, krypton, and xenon, can only to an insignificant degree be diffused through the material used for the tube components, whereas light gases, such as the often used gases hydrogen and helium, can be diffused through these components at suitable temperature. The stacked tubes are introduced into the first section of the belt-furnace which has an atmosphere consisting of a heavy, desirable gas, e.g. argon, mixed with a light gas, e.g. hydrogen or possibly helium, so that the total pressure becomes substantially atmospheric pressure. The mixing ratio is selected in such a way that the amount of heavy gas corresponds to the amount of heavy gas desired in the finished tube, whereas the light gas or gases are supplied in such an amount that the total pressure of the mixture is increased substantially to atmospheric pressure. At its passage through the first furnace section, the air which is from the start inside the stacked tubes is gradually replaced by the gases in the section, while, at the same time, the tubes are, during their passage, exposed to steadily higher temperatures until the soldering material melts and soldering occurs.

The tubes are thereafter conveyed to the second section of the furnace, where the temperature is slightly lower than the soldering temperature and where the gas atmosphere is composed almost exclusively of heavy gas, e.g. argon, substantially at atmospheric pressure. On the basis of the partial pressure difference inside and outside the tubes the light gas enclosed inside the tubes is diffused into the surrounding heavy gas. The heavy gas can, however, only to a very insignificant degree penetrate through the tube walls. Thus the pressure inside the tube is gradually decreased to the desired pressure. When reduced to room temperature, this pressure is often of the order of magnitude of 10 kPa. After the diffusion section the tube passes into the cooling section. Electrical stabilization follows as with the manufacturing methods referred to above.

It has been found that the diffusion time can be lowered when the gas pressure around the tubes is lowered in the diffusion step. When it is reduced to about 3–4 kPa or less, gas with the same proportion of heavy and light gas as in the filter gas can be used around the tube during diffusion. Most likely there will also occur effusion, which brings about a shortened processing time.

This method is described in the U.S. patent application Ser. No. 213,909 filed Dec. 8, 1980, now U.S. Pat. No. 4,383,723. Because of the shorter diffusion time the method is less energy-demanding than the method with diffusion at atmospheric pressure. This fact however is counteracted to a certain degree by the increased mechanical complexity of the belt-furnace. The requirement of a relatively good sealing between the furnace sections can in this case be achieved only by means of gate arrangements between the furnace sections. However, notwithstanding the somewhat higher complexity of the furnace, also this manufacturing method is simple and well-suited for continuous automatic manufacturing.

SUMMARY OF THE INVENTION

In the furnace system according to the present invention a substantial simplification is obtained of the aforementioned gate arrangement. Furthermore, a utilization rate of the furnace volume is obtained which cannot be achieved with the customary belt-fed furnace types. This results in a higher production capacity and less energy consumption per tube unit produced. In addition, there is a substantial decrease in required space. The system is primarily designed for use in connection with diffusion-based manufacturing according to the two specifications referred to above. But the system can also be used for a production that relates to the batch manufacturing referred to earlier, resulting in advantages with regard to equipment and adjustment to continuous automatic manufacturing. Also tubes which are designed for manufacturing according to the method with separate soldering and vacuum pumping plus gas-filling through exhaust tubes, can be manufactured in a furnace system according to the invention. The exhaust tube is in this case replaced by, e.g., a plate which not until soldering of the tube parts closes the electrode aperture to which the exhaust tube would otherwise have been soldered. Alternate adjustment changes can also be visualized.

BRIEF DESCRIPTION OF THE DRAWINGS

In order that the invention may be more fully understood, it will now be described by way of example, with reference to the accompanying drawing, in which.

DETAILED DESCRIPTION OF THE DRAWINGS

Figure 1:
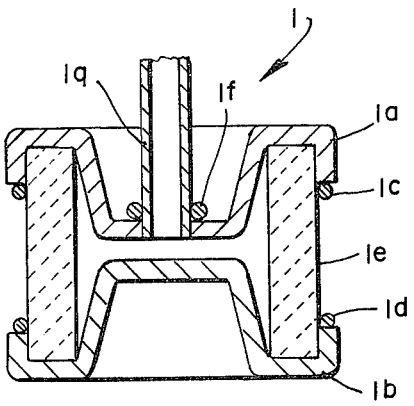
FIGS. 1 and 2 schematically illustrate sectional views of conventional embodiments for transient-protector tubes with two electrodes.

FIG. 1 shows a frequently occurring embodiment ofa twin-electrode tube 1. Two electrodes 1*a* and 1*b* of e.g. "Kovar", FeNiCo alloy or nickel-iron are pressed onto either end of a ceramic tube 1*e* which has metalized outer cylinder surfaces near its ends. The metallization usually consists of molybdenum-manganese which is coated with a surface layer of nickel. In a hole in the electrode 1*a* there has been introduced on exhaust tube 1*q*. The exhaust tube is often of copper. Adjoining the electrodes 1*a* and 1*b* and around the exhaust tube 1*q* at the hole in the electrode 1*a* are placed rings 1*c*, 1*d*, and 1*f* of soldering material, often a silver-copper eutectic.

The assembled tube unit is placed in a reducing hydrogen atmosphere and gradually heated to the melting point of the soldering material, which, for a copper-silver eutectic, lies just under 800° C. The melted soldering material penetrates between the electrodes 1*a* and 1*b* and the metalized end areas of the ceramic tube 1*e*, thereby soldering them together. At the same time the soldering material 1*f* melts and joins the electrode 1*a* to the exhaust tube 1*q*. Vacuum pumping, refill with suitable gas, pinch-off, and electrical treatment complete the process.

Figure 2:
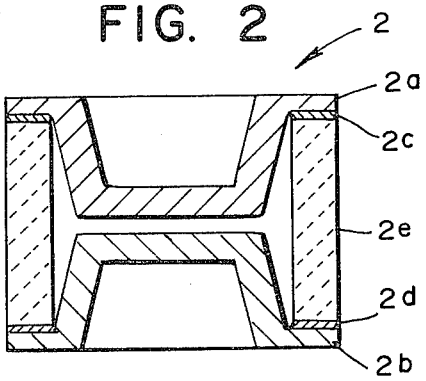

FIG. 2 shows a typical example of a two-electrode tube designed for the batch manufacturing method. In this case, the tube 2 includes the electrodes 2*a* and 2*b*. These are often made of pure copper, but other materials such as "Kovar" or nickel-iron can also be used. The ceramic tube 2*e* has its plane end surfaces metalized. The components are stacked loosely upon each other. First an electrode 2*b*, thereafter a solder ring 2*d*, then the ceramic tube 2*e* and finally a second solder ring 2*c* and a second electrode 2*a*. The simultaneous stacking of a few hundred tubes on a suitable treatment plate can be done semiautomatically. A number of such plates with stacked tubes are placed jointly in a furnace in which vacuum pumping, refill with suitable gas, and soldering of tube parts occur.

Figure 3:
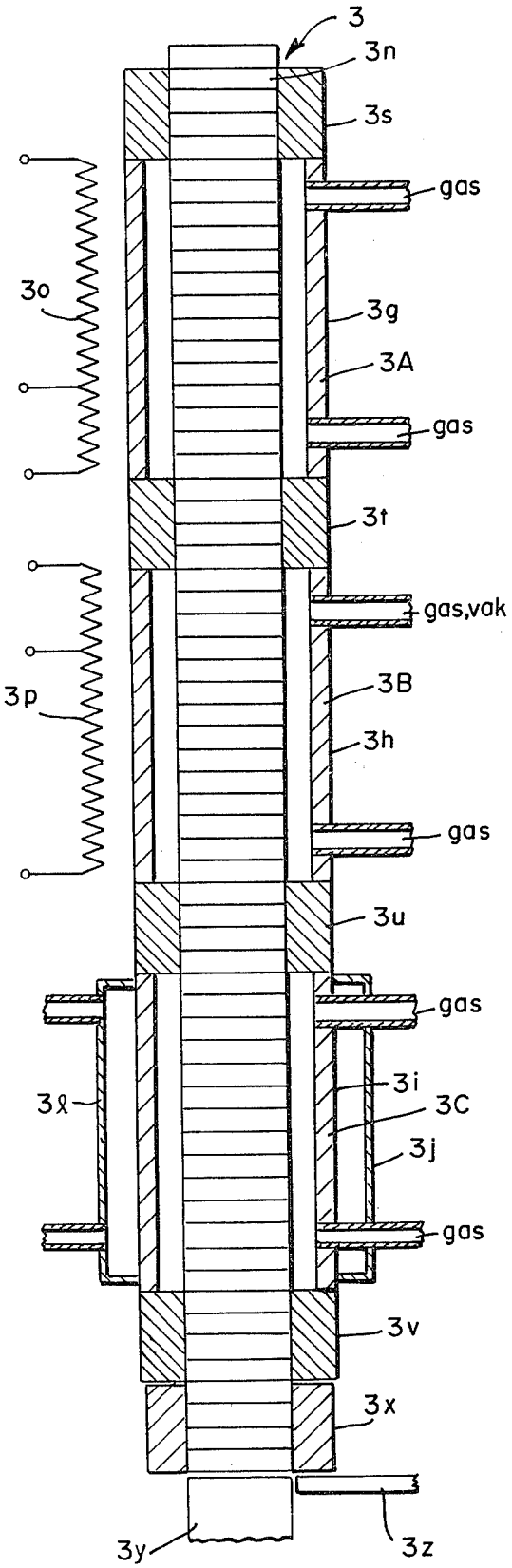
FIG. 3 shows in principle a furnace system according to the invention.

The furnace system 3 in FIG. 3 consists of three vertical treatment sections 3A, 3B and 3C, limited by the outer jackets 3*g*, 3*h*, and 3*i*, respectively, as well as the intermediate gate or sealing tubes 3*t* and 3*u* and the end gate tubes 3*s* and 3*v* in connection with vertically passing treatment trays 3*n*. In view of the high temperatures utilized in the treatment sections for the treatment of the discharge tubes such as preheating, brazing, diffision and effusion, both gate tubes and treatment trays should consist of suitable high temperature materials such as, for example, cast steel with graphite inclusions, alloys such as "Nimonic 90" (compound of mainly nickel, chromium, cobalt, etc.) or refractory materials such as alumina, beryllia or silicon carbide. The treatment sections 3A and 3B, in which the outer jackets 3*g* and 3*h* enter, can in the embodiment illustrated be heated by means of the electric heating elements 3*o* and 3*p*, whereas the treatment section 3C with the outer jacket 3*i* has been provided with the water cooling jacket 3 l. Each treatment section has arrangements for the inlet and outlet of suitable gases. In certain cases these arrangements can instead be connected to a suitable vacuum pump to lower the pressure in the treatment section in question.

The treatment trays 3*n*, in which the tubes are placed during the treatment, are guided through the treatment sections by suitable rails or in any other such way.

Figure 4:
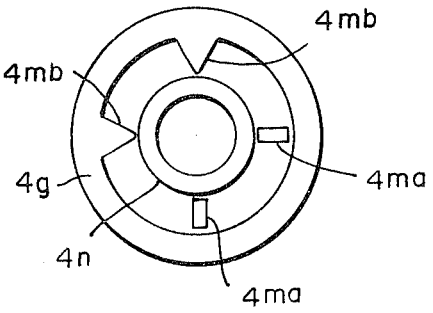
FIG. 4 indicates how guide rails can be arranged in the furnace sections.

These rails can be separate or form an integral part of the jacket tubes. The latter alternative is shown in FIG. 4, in which 4*n* are treatment trays, 4*g* jacket tubes with rails 4*mb* as an integral part. Separate rails are shown as 4*ma*.

Figure 5:
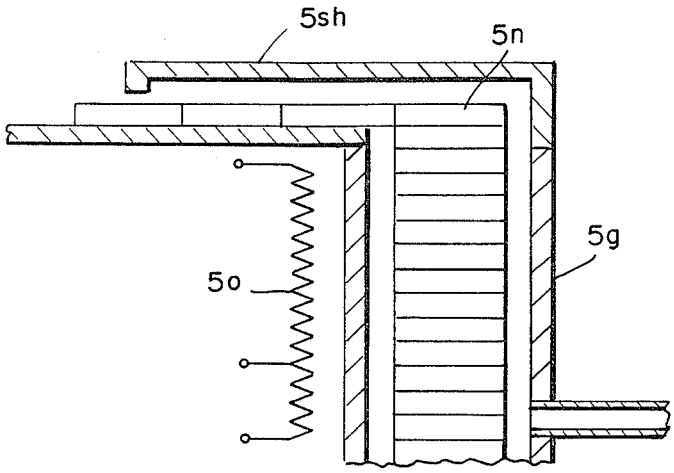
FIG. 5 illustrates diagramatically the arrangement of a horizontal feeding port to the first furnace section.

The stack of treatment trays 3*n* in FIG. 3 is shown resting on a support 3*y*. However, the cylindrically arranged brake blocks 3*x* can hold the stack when it is forced against the outer walls of the trays. We can visualize the brake blocks as holding the trays. The support is moved upwards against the bottom of the lower tray. The brake blocks 3*x* move outwards and the support 3*y* moves downward the height of one tray 3*n*. The entire stack follows by gravity effect. The brake blocks 3*x* again lock the stack, but the lower tray standing on the support 3*y* is not braked. The support 3*y* moves down a bit more and the freed tray 3*n* is removed from the support by a horizontal movement of the ejector 3*z*. Then the moving system is repeated. At the same time a new treatment tray is added to the top portion of the stack, which, in FIG. 3, corresponds to the gate tube 3*s*. In a number of cases this gate 3*s* can be eliminated and possibly be replaced by a feeding method usually applied in horizontal furnace arrangements, as shown in FIG. 5. In FIG. 5 the trays 5*n* are led to the stack's top 5*sh* at the upper end of the jacket tube 5*g* having heating element 5*o*.

The movements of the brake-support-ejector system can be reprogrammed to fill the furnace system with a stack of empty trays, when for one reason or other the furnace system becomes totally or partly empty of trays.

Instead of brake blocks of which each in itself affects several trays, as shown in FIG. 3, in which the brake blocks 3*x*, according to the drawing, affect four trays, more blocks can of course be installed in an annular system one on top of the other and, by way of example, in such a manner that each tray in the brake area receives its own annular system of blocks. This can bring about a more uniform braking effect on each individual tray.

Figure 6:
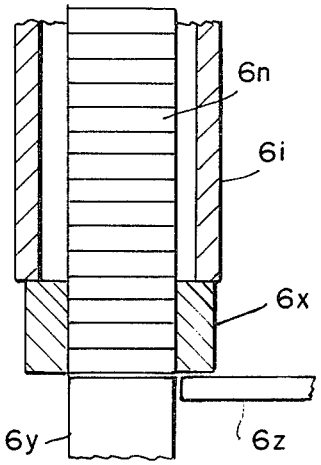
FIG. 6 illustrates diagramatically the use of a movement brake as gate arrangement.

The brake section can moreover replace the outlet gate of the cooling section, see FIG. 6 which schematically illustrates such an arrangement. The treatment trays 6*n* move in this instance directly from the cooling section of the furnace system within the jacket tube 6*i* to the brake system with the blocks 6*x*, the support 6*y*, and the ejector 6*z*.

Figure 7A:
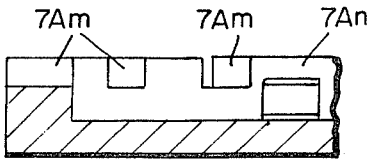
FIGS. 7A and 7B presents two ways of arranging the gas passage to the interior of the treatment trays.
Figure 7B:
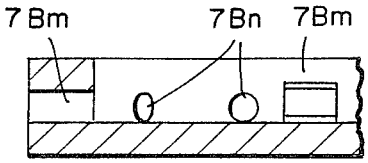

Since the treatment trays are placed directly on each other, they have to be provided with openings, preferably in their side walls, to make possible, among other things, that the treatment gases can to a sufficient degree replace other gases in the treatment trays and in the tubes placed therein during the treatment phases. FIGS. 7A and 7B show such an example. In the trays 7A*n*, openings 7A*m* have been provided in the upper side of the treatment trays, whereas, in the trays 7B*n*, holes 7B*m* have been arranged through the walls.

Figure 8A:
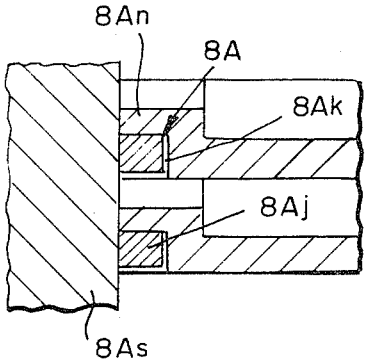
FIGS. 8A and 8B illustrates how grooves and sealing rings can be arranged in the interior of the gate tubes or in the outer walls of the treatment trays, respectively.

In cases where the sealing requirement exceeds the result which can be obtained by keeping a sufficiently low friction between the trays and the gate cylinders, FIG. 8A suggest a solution. The trays 8A*n* can be provided with sealing means 8A in the form of grooves 8A*k* in which rings 8A*j* preferably made of cast steel with graphite inclusions, are laid which have been slotted so that the diameter of the rings, due to the elasticity of the material, can be increased or decreased somewhat, and the rings have been applied in such a manner that their outsides are in contact with the inner surface of the gate cylinders 8A*s*.

Figure 8B:
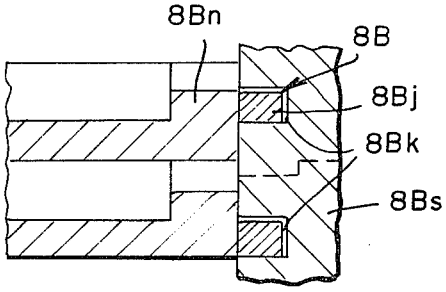

Alternately, as illustrated in FIG. 8B, the sealing means 8B in the form of grooves 8B*k*, with the rings 8B*j* arranged in the inner wall of the gate cylinder 8B*s*. These rings 8B*j* are designed in such a manner that they abut the passing outer wall surfaces of the trays 8B*n*. It can be advantageous in this case for the distance between the sealing rings 8B*j* to be somewhat different from the external height of the treatment trays.

For manufacturing considerations it may be justified that the gate cylinders with grooves be manufactured in sections as indicated by the dashed lines in FIG. 8B. The sections can later in a suitable manner be joined to a gate cylinder with a vacuum-tight wall.

For servicing purposes it may be desirable to provide for the possibility of opening the jacket tubes or the gate tubes of the furnace system.

The furnace system according to the invention, as discussed above, can be used for alternate manufacturing methods. Some of these will be described in brief. It is assumed in the following that the tubes are built up according to the stacking method of FIG. 2. It is further assumed that insulating bodies 2*e* are used to contain 94–98% aluminum oxide which are metalized with 80% molybdenum+20% manganese plus nickel-plating. Furthermore, electrodes 2*a*, 2*b* are made of copper, and solder rings 2*c*, 2*d* of a silver-copper eutectic with a melting point around 800° C. It is also assumed that the purpose is to manufacture tubes which, in their finished state, contain a gas mixture of approximately 90% argon and approximately 10% hydrogen which, at room temperature, has a total pressure of 10–15 kPa.

Three alternate manufacturing methods are discussed. The alternates are designated by A, B, and C and the treatment sections according to FIG. 3 are designated by 3*g*, 3*h*, and 3*i*.

A. Alternate to Conventional Batch Manufacturing

3*g*. Motion-dependent gradual heating to approximately 700° C. in counter-current hydrogen, or hydrogen in a mixture preferably with, at atmospheric pressure.

3*h*. Gradual temperature increase to soldering temperature at approximately 800° C. in concurrent or countercurrent 90% argon+10% hydrogen at a pressure of approximately 40 kPa, after which there occurs a reduction in temperature to approximately 700° C. The applied pressure is lower than atmospheric pressure, which is around 100 kPa. The lower pressure is obtained by evacuation and simultaneous restriction in the gas mixture supply. Some leakage of argon and hydrogen through the gates from the sections 3*g* and 3 l can be tolerated.

3*i*. Gradual cooling to a suitable outlet temperature preferablyin concurrent 90% argon+10% hydrogen at atmospheric pressure.

B. Diffusion Manufacturing (U.S. patent application Ser. No. 213,909 filed Dec. 8, 1980)

3*g*. Motion-dependent gradual heating to soldering temperature of approximately 800° C. in countercurrent gas consisting of approximately 38% argon+62% hydrogen, alternatively approximately 38% argon+6.5% hydrogen+55.5% helium at aproximately atmospheric pressure at prevailing temperature.

3*h*. Diffusion in countercurrent argon approximately at atmospheric pressure and about 700° C. A certain leakage from the sections 3*g* and 3*i* can be tolerated.

3*i*. Cooling as in A.

C. Manufacturing with the Use of Diffusion/Effusion (U.S. patent application Ser. No. 213,909, filed Dec. 8, 1980, now U.S. Pat. No. 4,383,723.

3*g*. Heating and soldering as in B

3*h*. Diffusion-effusion at approximately 700° C. in argon at a lower pressure than atmospheric pressure. Some leakage of gas from the sections 3*g* and 3*i* can be tolerated. If the pressure is reduced to approximately 4 kPa or less, the gas can consist entirely of leaking gas from the sections 3*g* and 3*i*.

3*i*. Cooling as in A.

It will be understood that various changes in the details, materials, arrangement of parts and operating conditions which have been herein described and illustrated in order to explain the results of the invention may be made by those skilled in the art within the principles and scope of the present invention.

I claim:

1. A furnace system for producing a vacuum-tight joining of stacked or suitably preassembled components of gas-discharge tubes disposed on treatment trays which are adapted to move through said furnace system for treatment, e.g. diffusion/effusion/cooling, after suitable pretreatment, such as preheating/preparation of the surface, comprising:

a. at least two hollow tubular-shaped treatment section means disposed vertically in co-axial alignment extending between an inlet end and an outlet end of said furnace system;

b. a hollow tubular-shaped gate means disposed between said treatment section means and in alignment therewith; and c. treatment tray means being dimensioned to pass through said gate means in a generally vertical direction, the materials and dimensions of said gate means and said treatment tray means being selected to provide a sealing effect between each said tray means and said two treatment section means without substantially increasing the friction between said treatment tray means and said gate means.

2. A furnace system according to claim 1, wherein at least one of said treatment tube section means includes a jacket tube means which has a larger inside cross-sectional diameter than the outside cross-sectional diameter of said treatment tube section means, said treatment tube means being provided with integrally formed tray guide rails extending inwardly between said treatment tube means and said treatment tray means.

3. A furnace system according to claim 2, further including at least one moving brake means, movable support means, and ejector means, disposed proximate said system outlet end and arranged in cooperating engagement to provide the passage of said treatment tray means through said treatment section means of said furnace system and through said outlet end.

4. A furnace system according to claim 1, further including metallic sealing means disposed proximate the outlet end and the inlet end of said furnace system which cooperate with said treatment tray means for providing a suitable sealing effect between the inside of the furnace system and the outside environment.

5. A furnace system according to claim 4, wherein the outside circumferential wall of said treatment tray means is provided with means for allowing the exchanging of gases between the treatment section means and the internal volume of said treatment tray means into which said suitably preassembled tube components are placed.

6. A furnace system according to claim 5, wherein the outside circumferential wall of said treatment tray means is provided with grooves into which metallic sealing rings are placed to obtain an increased sealing effect between said treatment tray means and said gate means without any substantially increased friction.

7. A furnace system according to claim 5, wherein the internal wall of said gate means is provided with grooves into which metallic sealing rings are placed to obtain an increased sealing effect between said treatment tray means and said gate means without any substantially increased friction.

8. A furnace system according to claim 5 further including heating means for independently heating each said treatment tube section means to a predetermined temperature.

9. A furnace system according to claim 6, wherein said treatment tube section means are provided with means adapted to be connected to external sources for providing a gas flow at atmospheric pressure or at a suitable lower pressure in said treatment tube section means.

10. A furnace system according to claim 6 further including heating means for independently heating each said treatment tube section means to a predetermined temperature.

11. A furnace system for producing a vacuum-tight joining of stacked or suitably preassembled components of gas-discharge tubes disposed on treatment trays which are adapted to move through said furnace system for treatment, e.g. diffusion/effusion/cooling, after suitable pretreatment, such as preheating/preparation of the surface, comprising:

a. at least two hollow tubular-shaped treatment section means disposed vertically in co-axial alignment extending between an inlet end and an outlet end of said furnace system;

b. a hollow tubular-shaped gate means disposed between said treatment section means and in alignment therewith;

c. treatment tray means being dimensioned to pass through said gate means in a generally vertical direction, the materials and dimensions of said gate means and said treatment tray means being selected to provide a sealing effect between said two treatment section means without substantially increasing the friction between said treatment tray means and said gate means;

d. moving brake means;

e. movable support means; and f. ejector means, said moving braking means, movable support means and said ejector means disposed proximate said system outlet end and arranged in cooperating engagement to provide the passage of said treatment tray means through said treatment section means of said furnace system and through said outlet end.

12. A furnace system according to claim 11, wherein at least one of said treatment tube section means includes a jacket tube means which has a larger inside cross-sectional diameter than the outside cross-sectional diameter of said treatment tray means, said jacket tube means being provided with integrally formed tray guide rails extending inwardly between said jacket tube means and said treatment tray means.

13. A furnace system according to claim 11, further including metallic sealing means proximate the outlet end and the inlet end of said furnace system which cooperates with said treatment tray means for providing a suitable sealing effect between the inside of the furnace system and the outside environment.

14. A furnace system according to claim 11, wherein the outside circumferential wall of said treatment tray means is provided with grooves into which metallic sealing rings are placed to obtain an increased sealing effect between said treatment tray means and said gate means without any substantially increased friction.

15. A furnace system according to claim 14, wherein said treatment tube section means is provided with means adapted to be connected to external sources for providing a gas flow at atmospheric pressure or at a suitable lower pressure in said treatment tube section means.

16. A furnace system according to claim 14 further including heating means for independently heating each said treatment tube section means to a predetermined temperature.

17. A furnace system according to claim 11, wherein the internal wall of said gate means is provided with grooves into which metallic sealing rings are placed to obtain an increased sealing effect between said treatment tray means and said gate means without any substantially increased friction.

* * * * *